US006411319B1

(12) United States Patent
Sugaya et al.

(10) Patent No.: US 6,411,319 B1
(45) Date of Patent: Jun. 25, 2002

(54) THERMAL HEAD, SURFACE-TREATING METHOD THEREFOR AND SURFACE-TREATING AGENT THEREFOR

(75) Inventors: Kengo Sugaya; Terutoshi Nakao, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/919,848

(22) Filed: Aug. 2, 2001

(30) Foreign Application Priority Data

Aug. 3, 2000 (JP) ..... 2000-236190

(51) Int. Cl.[7] ..... B41J 2/335
(52) U.S. Cl. ..... 347/203; 427/487; 427/521
(58) Field of Search ..... 347/203; 427/457, 427/487, 489, 490, 508, 575, 521

(56) References Cited

U.S. PATENT DOCUMENTS 6,281,921 B1 * 8/2001 Sugaya et al. ..... 347/203

FOREIGN PATENT DOCUMENTS

JP 6-106696 * 4/1994 ..... 347/203
JP 2000-301752 * 10/2000 ..... 347/203

* cited by examiner

*Primary Examiner*—Huan Tran
(74) *Attorney, Agent, or Firm*—Fitch, Even, Tabin & Flannery

(57) ABSTRACT

A protective layer of a thermal head is treated with a surface-treating agent containing a chlorosilyl group-containing compound and a fluoroalkyl group-containing silane compound to form a water-repellent oil-repellent dry film thereon. Both compounds are dissolved or suspended into an organic solvent such is an alcohol solvent. The solvent can contain 0 to 10 wt % of water based on the total weight of the solvent. The surface-treating agent may have a pH of 0 to 3, and both compounds are contained in an amount of 0.01 to 10 wt % in total based on the total amount of the treating agent. The treatment lowers the surface tension of the protective layer and thus prevents deposition of melt on the thermal head for a long period of time while maintaining thermal conduction and surface smoothness of the thermal head.

25 Claims, 1 Drawing Sheet

THERMAL HEAD, SURFACE-TREATING METHOD THEREFOR AND SURFACE-TREATING AGENT THEREFOR

BACKGROUND OF THE INVENTION

1. Field of the Invention

This invention relates to a thermal head that is modified on the surface thereof to be kept low in surface tension without inhibiting thermal conduction, and particularly relates to a thermal head that maintains excellent perforation property for a long period of time when used for perforating heat sensitive stencil sheets.

1. Description of Related Art Including Information Disclosed Under 37 CFR 1.97 and 1.98

As one of conventional methods of perforating heat sensitive stencil sheets, known is a stencil making method using a thermal head which is, in general, also called thermal printing head. In this method, the thermoplastic resin film face of a heat sensitive stencil sheet is brought into contact with a thermal head, for melting and perforating the thermoplastic resin film in an area corresponding to an image area of an original, by mean of heat of the thermal head.

However, if this method is used to continuously make stencils, there is a problem that the melt of the film is deposited on the surface of the thermal head to gradually degrade thermal perforation property of the thermal head.

In general, thermal heads can be structurally classified into thin film type, thick film type, semiconductor type, etc. The thin film type thermal head generally has, as shown in FIG. 1, a layered structure consisting of an insulating substrate 1, heat-generating resistor 2 formed on the insulating substrate 1, an electroconductive layer 3 connected with the heat-generating resistor 2 for supplying electric power to it, and a protective layer 4 covering the heat-generating resistor 2 and the electroconductive layer 3. The thick film type thermal head generally has, as shown in FIG. 2, a similar layered structure consisting of an insulating substrate 1, a heat-generating resistor 2 and an electroconductive layer 3 formed on the insulating substrate 1, and a protective layer 4 covering the electroconductive layer 3 and the hear-generating resistor 2. Therefore, the surface of a thermal head generally means the surface of the protective layer 4.

As the material of the protective layer 4, an inorganic material having relatively good thermal conductivity such as $Ta_2O_5$, $SiO_2$, SiON or $Si_3N_3$ is used. However, since these inorganic materials have high surface free energy, they have high surface tension, and thus have such a nature that the melt of the film is likely to be deposited on the surface of the thermal head.

To solve the above problem, it is proposed to coat the film surface of a heat sensitive stencil sheet with a releasing agent (JP-A-61-170392) or to let a heat sensitive stencil sheet contain a releasing agent in the porous substrate or adhesive layer thereof (JP-A-2-255384). However, since these methods have a releasing agent applied to a heat sensitive stencil sheet, the have such disadvantages that the stencil sheet production process is complicated to raise production cost and that uniform performance is difficult to obtain.

To overcome these disadvantages, it is proposed to further form a water-repellent, oil-repellent and heat-resistant resin layer on the surface of the thermal head, i.e., the protective layer 4, for preventing the deposition of the melt of the film onto the surface (see JP-Y-4-7967, JP-A-60-2382, JP-A-60-178068, JP-A-62-48569, etc.). The resin layer is typically made of a fluorine resin such as Teflon (trade name of Du Pont: polytetrafluoroethylene). For coating the surface of a thermal ahead with such a fluorine resin, it is usually necessary to prepare a dispersion containing 50 to 60% solid polytetrafluoroethylene, to coat the surface of a thermal head with the dispersion, to preliminary dry and to heat up to about 350° C.

The fluorine resin layer is excellent in making the surface of a thermal head lower in surface tension, but the treatment process (heating process) thermally loads the electronic parts associated with the thermal head. So, the method cannot be said to be a simple and proper treatment method. Furthermore, the fluorine resin has such a problem that bonding strength to vitreous materials such as the protective layer is not sufficient.

Moreover, since the above resin layer is a coating layer of resin, even if thin coating is made, the thickness becomes about 1 $\mu$m, to inhibit the efficient thermal conduction from the heat-generating resistor to the surface. There is also a limit in making the thickness of the resin layer uniform for enhancing the surface smoothness, and the actually obtained thickness and surface roughness are on the order of microns.

Above all, in the case where such a thermal head is used to process heat sensitive stencil sheets into stencils, there is a problem that the roughness of the resin layer formed on the surface of the thermal head inhibits close contact between the thermal head and the heat sensitive stencil sheet, thereby lowering the thermal conductivity. As a result, uniform perforation of the heat sensitive stencil sheet cannot be ensured.

Furthermore, as other methods for making the surface of a thermal head lower in surface tension, proposed are a technique comprising the step of coating the surface of the protective layer with a fluoroalkyl group-containing silane compound for forming a water-repellent, oil-repellent film, and a technique comprising the steps of pre-treating the protective layer using, for example, silicon oxide for forming an undercoating layer and forming said water-repellent, oil-repellent film on the undercoating layer, to make a two-layer structure, in order to improve the bonding strength between the water-repellent, oil-repellent film and the protective layer (Japanese Patent Application No. 2000-30694). The former method is a very simple and advantageous method for making the protective layer lower in surface tension without inhibiting the thermal conductivity since the obtained water-repellent, oil-repellent film is a uniform film of molecular level by virtue of properties of the fluoroalkyl group-containing silane compound. However, the method may be insufficient in performance in applications that require film durability such as scratch resistance. On the other hand, the latter method has a disadvantage that production cost is raised since the work basically consisting of two steps complicates the thermal head production process, though it can be expected that durability will be higher compared with the former method.

The object of this invention is to overcome the problems of the above-mentioned prior art, that is, to lower the surface tension of the protective layer by a simple method for preventing the deposition of the melt on the thermal head for a lone time while maintaining the thermal conductivity from the heat-generating resistor to the surface of the thermal head and the smoothness of the protective layer.

BRIEF SUMMARY OF THE INVENTION

According to this invention, the above object can be achieved by a thermal head which comprises an insulating substrate, a heat-generating resistor formed on the insulating substrate, an electroconductive layer connected with the heat-generating resistor for supplying electric power to it, and a protective layer formed on the heat-generating resistor and the electroconductive layer, wherein said protective layer is treated on the surface thereof with a dry film of a surface-treating agent containing a chlorosilyl group-containing compound and a fluoroalkyl group-containing silane compound.

The surface-treating agent can be produced, for example, by a method of dissolving a chlorosilyl group-containing compound and a fluoroalkyl group-containing silane compound into an organic solvent. Then, the surface-treating agent can be coated on the surface of the protective layer of the thermal head and dried, to form a water-repellent, oil-repellent film on the surface.

Thus, according to another aspect of this invention, there is provided a surface-treating agent containing a chlorosilyl group-containing compound and a fluoroalkyl group-containing silane compound in an organic solvent, for making tie vitreous surface of a thermal head water-repellent and oil-repellent.

According to a further other aspect of this invention, there is provided a method of treating a surface of a thermal head having an insulating substrate, a heat-generating resistor formed on the insulating substrate, an electroconductive layer connected with the heat-generating resistor for supplying electric power to it, and a protective layer formed on the heat-generating resistor and the electroconductive layer, which comprises the steps of coating the surface of the protective layer with said surface-treating agent and drying, in order to modify the thermal head to be water-repellent and oil-repellent on the surface of the protective layer.

The protective layer of a thermal head is usually made of a vitreous material containing $Ta_2O_5$, $SiO_2$, SiON or $Si_3N_3$, etc. So, if a fluoroalkyl group-containing silane compound that is a water-repellent, oil-repellent and heat-resistant compound is used as a surface-treating agent, the surface of the protective layer can be modified into a water-repellent, oil-repellent and heat-resistant surface. The fluoroalkyl group-containing silane compound is hydrolyzed with water in a solution, moisture in air or moisture adsorbed on a surface of inorganic materials, to produce highly reactive silanol groups (Si—OH). The silanol groups are reactive groups that can be adsorbed by or chemically bonded to the surface of inorganic materials. So, if they are used for treating the surface of the protective layer of the thermal head, which is composed of a vitreous material, the surface of the protective layer can be chemically modified. The surface-treating agent of this invention has a chlorosilyl group-containing compound coexisting with the fluoroalkyl group-containing silane compound. The chlorosilyl group-containing compound is hydrolyzed with water in a solution, moisture in air or moisture adsorbed on a surface of inorganic materials to produce highly reactive silanol groups (Si—OH), like the fluoroalkyl group-containing silane compound, and byproduces hydrochloric acid to promote the hydrolysis of the fluoroalkyl group-containing silane compound. At the same time, it is combined with the hydrophilic groups (—OH groups, etc.) on the surface of the protective layer or reacts with the silanol groups (Si—OH) of the fluoroalkyl group-containing silane compound, to form a polysiloxane. Therefore, production of the water-repellent, oil-repellent film is promoted, and the film is strengthened.

As described above, according to this invention, a very durable water-repellent, oil-repellent film that is mainly composed of silicon oxide and also contains fluoroalkyl groups can be simply formed on the surface of the protective layer of the thermal head by one step based on a sol-gel method, and excellent properties can be maintained for a long period of time. Furthermore, it is confirmed that the surface treatment of this invention can improve the contact angle of the surface of the protective layer against water up to 95° or more. Moreover, since the silanol groups are combined with the hydrophilic groups such as —OH groups existing on a solid surface, every vitreous surface can be modified to be water-repellent and oil-repellent as far as it is composed of a material capable of providing said hydrophilic groups.

DETAILED DESCRIPTION OF THE INVENTION

Figure 1:
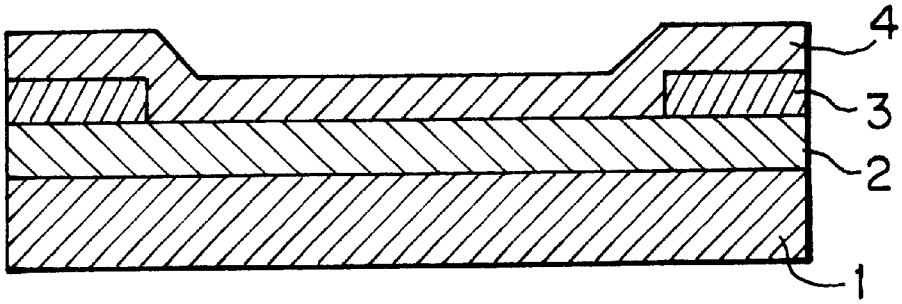
FIG. 1 is a sectional view showing a conventional general thermal head.
Figure 2:
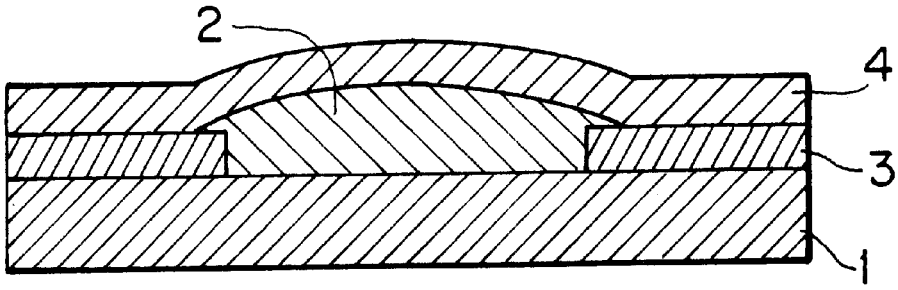
FIG. 2 is a sectional view showing a conventional general thermal head.

The chlorosilyl group-containing compound used in this invention refers to a compound having in molecule at least one chlorosilyl group which is represented by the formula $—SiCl_nX_{3-n}$, where n denotes 1, 2 or 3, and X denotes a hydrogen atom, or alkyl group, alkoxy group or acyloxy group respectively having 1 to 10 carbon atoms). Among them, a compound having in molecule at least two chlorine atoms combined with the silicon atom is preferable. For example, a chlorosilane obtained by substituting at least two hydrogen atoms of a silane $Si_nH_{2n+2}$ (where n denotes an integer of 1 to 5) with chlorine atoms and substituting the other hydrogen atoms, as required, by alkyl groups, alkoxy groups or acyloxy groups, or a partial hydrolysis product or polycondensation product thereof is preferable. Examples of the chlorosilyl group-containing compound include chlorosilanes such as tetrachlorosilane ($SiCl_4$), trichlorosilane ($SiHCl_3$), trichloromonomethylsilane ($SiCH_3Cl_3$) and dichlorosilane ($SiH_2Cl_2$), and polychlorosiloxanes represented by the formula $Cl(SiCl_2O)_nSiCl_3$ (n denotes an integer of 1 to 10). These compounds may be used alone or in combination of two or more. The most preferable chlorosilyl group-containing compound is tetrachlorosilane.

As the fluoroalkyl group-containing silane compound used in this invention, a silane compound containing a fluoroalkyl group and also containing an alkoxy group, acyloxy group or chloro group can be preferably used. For example, the compounds represented by the following chemical formula (1) can be used, and these compounds may be used alone or in combination of two or more.

$$CF_3(CF_2)_m(CH_2)_nSiR_pX_{3-p} \quad (1)$$

(where R denotes a substituted or non-substituted monovalent hydrocarbon group; X denotes a hydrolysable group; m denotes an integer of 5 to 10; n denotes an integer of 2 to 10; and p denotes 0 or an integer of 1 or 2) Examples of the above-mentioned substituted or non-substituted monovalent hydrocarbon group (R) include alkyl groups such as methyl group, ethyl group, propyl group and hexyl group, alkenyl groups such as vinyl group and allyl group, cycloalkyl groups such as cyclopentyl group and cyclohexyl group, aryl groups such as phenyl group and tolyl group, and those which are partially substituted with a halogen atom, amino group, hydroxyl group or alkoxy group.

Examples of the above-mentioned hydrolysable group (X) include alkoxy groups such as methoxy group, ethoxy group, isopropoxy group, n-propoxy group and n-butoxy group, aminoxy group, ketoxime group, acetoxy group, amide group and alkenyloxy group. Among them, an alkoxy group such as methoxy group or ethoxy group is preferable, since good pot life as well as reactivity and good water-repellence and oil-repellence can be obtained.

Examples of the above-mentioned fluoroalkyl group-containing silane compound include $CF_3(CF_2)_5CH_2CH_2Si(OCH_3)_3$, $CF_3(CF_2)_7CH_2CH_2Si(OCH_3)_3$, $CF_3(CF_2)_9CH_2CH_2Si(OCH_3)_3$, $CF_3(CF_2)_7CH_2CH_2Si(OC_2H_5)_3$, $CF_3(CF_2)_7CH_2CH_2Si(CH_3)(OCH_3)_2$, $CF_3(CF_2)_7CH_2CH_2SiCl_3$, $CF_3(CF_2)_7CH_2CH_2SiCl_2CH_3$, etc. A compound having a fluoroalkyl group with a carbon number of 6 to 10 is preferable, and more preferably 8 to 10. These compounds may be used alone or in combination of two or more.

The organic solvent used in this invention is not especially limited, as long as it allows the fluoroalkyl group-containing silane compound and the chlorosilyl group-containing compound to be dissolved or dispersed. A hydrophilic solvent such as an alcohol solvent or ketone solvent is preferable. Such a hydrophilic solvent is convenient since it allows the chlorine atom of the chlorosilyl group-containing compound to be substituted by an alkoxyl group or hydroxyl group by means of alcohol and/or water contained in the hydrophilic solvent, to cause a hydrogen chloride removing reaction. As the alcohol solvent, a saturated monohydric chain alcohol with 3 or less carbon atoms such as methanol, ethanol, 1-propanol or 2-propanol can be preferably used, since it has a high evaporation rate at room temperature. As the ketone solvent, for example, acetone or methyl ethyl ketone can be used.

The hydrophilic solvent does not necessarily contain an alcohol, provided that it contains water in an amount necessary to cause the hydrogen chloride removing reaction. Furthermore, it is not necessary that the hydrophilic solvent consists of one solvent only, and it can be a mixture with a non-aqueous solvent including hydrocarbon or fluorine compound based solvents.

When the chlorosilyl group-containing compound and the fluoroalkyl group-containing silane compound are dissolved into a hydrophilic solvent, the fluoroalkyl group-containing silane compound and the chlorosilyl group-containing compound cause various chemical reaction with the hydrophilic solvent and thereby exist stably therein.

For example, when an alcohol solvent is used as the solvent, the chlorosilyl group-containing compound in the solution reacts with the alcohol solvent, to remove hydrogen chloride and form an alkoxide as shown in formula (2) below. Furthermore, the chlorosilyl group-containing compound reacts with water slightly contained in the alcohol solvent and in the atmosphere, to be hydrolyzed and produce hydrogen chloride as shown in formula (3) below. In this instance, silanol groups (—Si—OH) are produced.

$$(\text{—Si—Cl})+(\text{ROH})\ (\text{—Si—OR})+(\text{HCl}) \tag{2}$$

where R denotes an alkyl group of the alcohol solvent.

$$(\text{—Si—Cl})+(\text{H}_2\text{O})\ (\text{—Si—OH})+(\text{HCl}) \tag{3}$$

The hydrochloric acid produced by the reactions of the formulae (2) and (3) in the alcohol solvent acts as a reaction catalyst of formula (4) below, causing some of (—Si—OR) groups to be converted to produce silanol groups (—Si—OH) by way of further hydrolysis reaction.

$$(\text{—Si—OR})+(\text{H}_2\text{O})\ (\text{—Si—OH})+(\text{ROH}) \tag{4}$$

Some of the silanol groups (—Si—OH) produced in the reactions of formulae (3) and (4) react as shown in formula (5) to form siloxane bonds (—Si—O—Si—).

$$(\text{—Si—Cl})+(\text{—Si—OH})\ (\text{—Si—O—Si—})+(\text{HCl}) \tag{5}$$

Furthermore, some of the produced silanol groups (—Si—OH) are converted to form siloxane bonds by way of a dehydration condensation reaction as shown by formula (6).

$$(\text{—Si—OH})+(\text{—Si—OH})\ (\text{—Si—O—Si—})+(\text{H}_2\text{O}) \tag{6}$$

Since the reactivity of the chlorine atoms of the chlorosilyl group-containing compound are very high, almost all the chlorine atoms of the chlorosilyl group-containing compound in the alcohol solvent react and change into (—Si—OR), (—Si—OH), (—Si—O—Si—) and (HCl), and these exist together. That is, the above-mentioned solution contains, in the alcohol solvent, silicone alkoxides or hydrolysis products thereof, and fluoroalkyl group-containing silane compounds or hydrolysis products thereof, as well as hydrochloric acid. Furthermore, even when the solvent is another hydrophilic solvent than an alcohol solvent, the chlorine atoms react with water contained in the hydrophilic solvent and change into (—Si—OH), (—Si—O—Si—) and (HCl) as shown in formulae (3) and (4).

The reactivity of the chlorine atoms of the chlorosilyl group-containing compound is very high, and it is usually difficult to handle a chlorosilyl group-containing compound alone, but since few chlorine atoms exist in a hydrophilic solvent in the solution, the solution is excellently stable and is little affected by the humidity in the working atmosphere. Thus, it apparent that the solution is also easy to handle.

Factors which promote the hydrolysis reaction and the dehydration condensation reaction as shown in formulae (4) and (6) in the solution are influenced by acid concentration of the solution, water content of the solvent, and concentrations of the silicone alkoxide and the fluoroalkyl group-containing silane compound or their hydrolysis products.

Since stability of the solution as a system depends on acidity of the solution, it is preferable that pH of the solution is adjusted to 0 to 3. If the pH is in this range, the hydrolysis reaction of the silicon alkoxide and the condensation reaction represented by formulae (4) and (6) are unlikely to occur. So, the chlorosilyl group-containing compound can be held stably for a long period of time in the solution in the forms of a silicone alkoxide and the hydrolysis product thereof, and pot life of the solution can be adequately maintained.

It is preferable that the acid concentration in the solution is in a range of 0.001 to 3N as hydrochloric acid. A more preferable range is 0.01 to 1N. If the acid concentration is less than 0.001N, the hydrolysis reaction of the silicon alkoxide and the condensation reaction in the solution become slow. If more than 3N, the condensation reaction of the partial decomposition product of the silicon alkoxide in the solution is likely to occur, thereby shortening the pot life of the solution. In case where the surface treatment is completed with application of the solution before the condensation reaction takes place, it is not necessary to keep the acid concentration within the above range.

In case where the amount of the chlorosilyl group-containing compound in the solution is small and the acid concentration is low, it is desirable to add an acid to the solution to adjust the acid concentration. The acid is advantageously one that volatilizes and does not remain in the film when dried at room temperature. Preferred examples of the volatile acid are hydrochloric acid, nitric acid, hydrofluoric acid or acetic acid. Above all, hydrochloric acid is most preferable since it is highly volatile and relatively safe.

When the water content of the solution is low, the reactions of formulae (4) and (6) become unlikely to occur. On the other hand, if the water content of the solution is large, the hydrolysis reaction of the partial hydrolysis product of the silicon alkoxide in the solution is promoted, and the dehydration condensation reaction is likely to occur. So, the pot life of the solution is shortened, and when the applied solution is dried, the film thickness is likely to be irregular. Therefore, to elongate the pot life of the solution, it is desirable that the water content of the solution is as low as possible. For this reason, it is preferable that the water content of the solution is 0 to 10 wt %. The most preferable range is 0 to 2 wt %.

By adjusting the water content of the solution as described above, the reactions of formulae (4) and (6) can be made to be unlikely to occur, thereby allowing the pot life of the solution to be elongated. Even when the water content of the solution is zero, it does not happen that the hydrolysis reaction is inhibited since the film obtained by coating the solution absorbs water in air, and a strong water-repellent, oil-repellent layer can be obtained.

Stability of the solution also depends on the concentrations of the silicon alkoxide, fluoroalkyl group-containing silane compound and their hydrolysis products in the solution. Therefore, it is desirable that the concentration in total of the chlorosilyl group-containing compound and the fluoroalkyl group-containing silane compound in the solution is 0.01 wt % to 10 wt % based on the total weight of the solution. If the concentration is more than 10 wt %, the reactions of formulae (4) and (6) are likely to occur, thereby shortening the pot life of the solution, since the concentrations of the alkoxide or the hydrolysis product and the condensation product thereof in the solution become high. If less than 0.01 wt %, when the surface to be treated is coated with the solution, a sufficient film thickness cannot be obtained, and it can happen that a sufficient surface treatment effect is not obtained.

The mixing ratio of the chlorosilyl group-containing compound and the fluoroalkyl group-containing silane compound is described below. If the content of the chlorosilyl group-containing compound in the solution is too large compared with the content of the fluoroalkyl group-containing silane compound, the water-repelling oil-repelling performance of the water-repellent, oil-repellent film declines, and if too small, the durability of the water-repellent film declines. Therefore, it is preferable that the amount of the chlorosilyl group-containing compound in the solution is 5 to 500 as a molar ratio to the amount of the fluoroalkyl group-containing silane compound. The most preferable range is 10 to 300.

The surface-treating agent of this invention can be produced by a method of adding a fluoroalkyl group-containing silane compound to an organic solvent, stirring for 10 to 60 minutes, adding a chlorosilyl group-containing compound, and stirring for 10 to 60 minutes. Pot life of the solution is very long, but it is preferable to use it for surface treatment within 2 hours after production, since hydrolysis and polycondensation reaction are likely to take place in the solution in case where the amount of the acid is relatively small or large or where contents of the chlorosilyl group-containing compound and water are large. If the solution produced as described above is applied to cover a surface to be treated, such as the surface of the protective layer of a thermal head and dried at room temperature for more than 10 seconds to evaporate the solvent, a water-repellent, oil-repellent film can be formed on the surface. Then, if it is heat-treated as required, a stronger film can be obtained.

The method for applying the surface-treating agent of this invention is not especially limited. For example, a cloth impregnated with the treating agent can be used for manual coating, or the surface to be treated can also be dipped or coated using a roller, brush or blade. Furthermore, for example, spin coating and spray coating can also be used.

If the protective layer of a thermal head is coated with the solution, the solvent in the formed film evaporates, thereby suddenly increasing the concentration of the silicon alkoxide or the hydrolysis product thereof in the film, and with the high reactivity of the chlorosilyl groups, the hydrolysis reaction and the dehydration condensation reaction that have been inhibited till then occur suddenly. That is, numerous siloxane bonds (—Si—O—Si—) are produced in the film. Some of the siloxane bonds are produced due to the reaction with the fluoroalkyl group-containing silane compound, and others are produced due to the reaction with the —OH groups on the surface of the protective layer. As a result, a water-repellent, oil-repellent film mainly composed of silicon oxide strongly bonded to the surface of the protective layer can be formed. As described here, in this invention, since the reactivity of hydrolysis and dehydration condensation during the film formation is very high, the reactions take place sufficiently even in atmospheric air, and a very dense film can be formed.

In the process of film formation, the surface-treating agent of this invention makes its water-repelling groups automatically oriented toward the outside of the treated surface, thereby forming a dry water-repellent, oil-repellent film. That is, if the surface to be treated is coated with the treating agent, the alkoxy groups of the fluoroalkyl group-containing silane compound in the solution cause reactions similar to the above-mentioned reactions of the silicon alkoxide. In this case, since the fluoroalkyl groups of the fluoroalkyl group-containing compound have low surface free energy, the fluoroalkylsilane component automatically migrates toward the outside of the film, and the fluoroalkyl group portions are regularly oriented toward the outside of the film. As a result, the fluoroalkyl groups exist at a higher concentration in the outside surface layer of the film than in the inner layer of the film. If the film is progressively dried, the alkoxy groups of the silicon alkoxide and the alkoxy groups (or acyloxy groups or chlorine atoms) of the fluoroalkyl group-containing silane compound allow the reactions represented by formulae (4) and (6) to take place, while the fluoroalkyl group-containing silane compound is kept oriented. The fluoroalkyl group-containing silane compound is strongly combined with the silicon alkoxide through siloxane bonds, and then finally forms a gel layer of a fluoroalkylsilane-modified silanol polymer.

If the formed film is progressively dried, a strongly bonded layer mainly composed of silicon oxide is formed on the protective layer, and fluoroalkyl groups are bonded to the silicon oxide layer in a state regularly oriented at a high density. With the surface-treating agent of this invention, the reaction in which siloxane bonds are formed between the silicon atoms of the silicon alkoxide and the reaction in which siloxane bonds are formed between the silicon atoms on the surface of the protective layer and the silicon atoms in the silicon alkoxide are more likely to take place than the reaction in which siloxane bonds are formed between the fluoroalkyl group-containing silane compound and the silicon alkoxide. As a result, the fluoroalkyl groups are likely to gather in the outmost surface of the film. Therefore, in this invention, a water-repellent, oil-repellent film with a high density of water-repellent groups on the outermost surface thereof can be obtained.

It is preferable that the thickness of the dried film is 10 nm to 500 nm. Though depending on the coating method, if a surface-treating solution is prepared as described above to keep the concentration in total of the chlorosilyl group-containing compound and the fluoroalkyl group-containing silane compound in the solution at 0.01 wt % to 10 wt % based on the total weight of the solution, this film thickness can be usually achieved. If the film thickness is smaller than 10 nm, the water-repellence and the oil-repellence tend to be poor. The reason is considered to be that the fluoroalkyl groups are not sufficiently oriented toward the surface of the film at the film-forming stage. On the other hand, if the film thickness is larger than 500 nm, it can happen that the film is cracked in the steps of coating and drying at room temperature and that thermal conductivity and surface smoothness of the thermal head are impaired.

DESCRIPTION OF THE PREFERRED EMBODIMENT

EXAMPLES

This invention is described below in more detail with reference to examples, but is not limited thereto or thereby.

Example 1

Zero point zero two (0.02) gram of heptadecafluorodecyltrimethoxysilane $\{CF_3(CF_2)_7(CH_2)_2Si(OCH_3)_3\}$ was added to 100 g of ethanol (water content 0.35 wt %), and the mixture was stirred for 30 minutes. Then, 1.0 g of tetrachlorosilane ($SiCl_4$, produced by Shin-Etsu Silicone) was added with stirring, to obtain a solution to be used for forming a water-repellent film. The solution had a hydrochloric acid concentration of about 0.2N, a water content of 0.35 wt %, and a pH of about 0.7.

Figure 3:
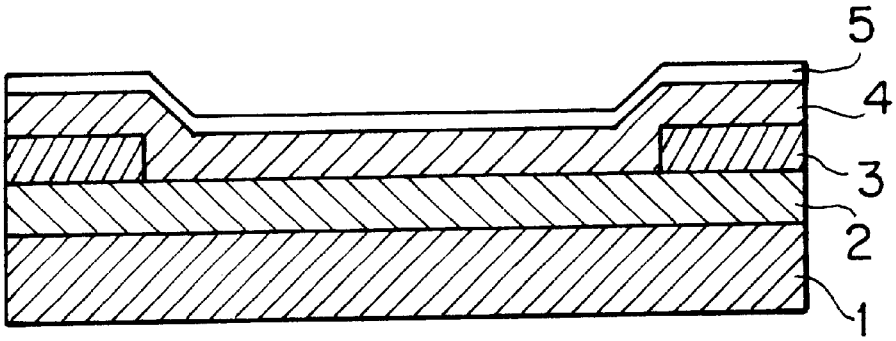
FIG. 3 is a sectional view showing a thermal head as an example of this invention.

A thermal head equipped with a Ta—$SiO_2$-sputtered layer as a protective layer (see FIG. 1) was prepared, and the surface of the protective layer was washed with alcohol. Then, the surface was manually coated with the above-obtained surface-treating agent using a cloth impregnated with the treating agent. It was dried in air at room temperature for 10 minutes, to produce a thermal head modified on the protective layer thereof. That is, as shown in FIG. 3, a film 5 was formed on the protective layer 4 of a conventional thermal head.

Performance of the surface-treated thermal head was tested as described below. The results are shown in Table 1.

Example 2

A thermal head modified on the protective layer was produced as described for Example 1, except that the drying temperature was changed to 90° C.

Performance of the surface-treated thermal head was tested as described below. The results are shown in Table 1.

Example 3

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.006 g.

Performance of the surface-treated thermal head was tested as described below. The results are shown in Table 1.

Example 4

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.06 g.

Performance of the surface-treated thermal head was tested as described below. The results are shown in Table 1.

Example 5

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.12 g, and that the amount tetrachlorosilane ($SiCl_4$) was changed to 6.0 g.

Performance of the surface-treated thermal head was tested as described below. The results are shown in Table 1.

Example 6

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.24 g, and that the amount of tetrachlorosilane ($SiCl_4$) was changed to 12.0 g.

Performance of the surface-treated thermal head was tested as described below. The results are shown in Table 1.

Example 7

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.006 g, and that the amount of tetrachlorosilane ($SiCl_4$) was changed to 0.25 g.

Performance of the surface-treated thermal head was tested as described below. The results are shown in Table 1.

Example 8

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.2 g, and that the amount of tetrachlorosilane ($SiCl_4$) was changed to 0.5 g.

Performance of the surface-treated thermal head was tested as described below. The results are shown in Table 1.

Example 9

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.7 g, and that the amount of tetrachlorosilane ($SiCl_4$) was changed to 0.5 g.

Performance of the surface-treated thermal head was tested as described below. The results are shown in Table 1.

Example 10

A surface-treating agent was prepared to produce a thermal head modified on the protective layer as described for Example 1, except that the amount of heptadecafluorodecyltrimethoxysilane $\{CF_3(CF_2)_7(CH_2)_2Si(OCH_3)_3\}$ was changed to 0.7 g, and that the amount of tetrachlorosilane ($SiCl_4$) was changed to 0.3 g.

Performance of the surface-treated thermal head was tested as described below. The results are shown in Table 1.

Example 11

A composition was prepared and a thermal head modified on the protective layer was produced and tested as described for Example 1, except that tridecafluorooctyltrimethoxysilane $\{CF_3(CF_2)_5CH_2CH_2Si(OCH_3)_3\}$ was used instead of heptadecafluorodecyltrimethoxysilane $\{CF_3(CF_2)_7 CH_2CH_2Si(OCH_3)_3\}$.

Performance of the surface-treated thermal head was tested as described below. The results are shown in Table 1.

Example 12

A composition was prepared and a thermal head modified on the protective layer was produced and tested as described for Example 1, except that heneicosafluorododecacyltrimethoxysilane $\{CF_3(CF_2)_9CH_2CH_2Si(OCH_3)_3\}$ was used instead of heptadecafluorodecyltrimethoxysilane $\{CF_3(CF_2)_7 CH_2CH_2Si(OCH_3)_3\}$.

Performance of the surface-treated thermal head was tested as described below. The results are shown in Table 1.

Example 13

A composition was prepared and a thermal head modified on the protective layer was produced and tested as described for Example 1, except that heptadecafluorodecyltrichlorosilane $\{CF_3(CF_2)_9CH_2CH_2SiCl_3\}$ was used instead of heptadecafluorodecyltrimethoxysilane $\{CF_3(CF_2)_7 CH_2CH_2Si(OCH_3)_3\}$.

Performance of the surface-treated thermal head was tested as described below. The results are shown in Table 1.

Example 14

A thermal head modified on the protective layer was produced and tested as described for Example 1, except that 90 g of ethanol and 10 g of water were used instead of 100 g of ethanol (water content 0.35 wt %) when the solution was prepared.

Performance of the surface-treated thermal head was tested as described below. The results are shown in Table 1.

Comparative Example 1

A non-treated thermal head was used and tested as described for Example 1.

Comparative Example 2

Associated electronic parts with low heat resistance were removed from a thermal head as used in Example 1. Then, the surface of the protective layer of the thermal head was coated with a dispersion containing solid polytetrafluoroethylene, preliminarily dried at room temperature, and heat-treated at about 350° C., to obtain a thermal head in which the protective layer was covered with a resin layer of polytetrafluoroethylene.

Performance of the surface-treated thermal head was tested as described below. The results are shown in Table 1.

Comparative Example 3

Two parts of heptadecafluorodecyltrimethoxysilane $\{CF_3(CF_2)_7CH_2CH_2Si(OCH_3)_3\}$ as a fluoroalkylsilane (formula 1) were added to 97 parts of isopropyl alcohol, and the mixture was mixed. To it, 1 part of nitric acid (61% concentration) was added as a hydrolysis catalyst, and the mixture was homogeneously mixed, to prepare a treating agent.

The surface of the protective layer of a thermal head as used in Example 1 was washed with alcohol, manually coated with the above-obtained treating agent using a cloth impregnated with the treating agent, and dried in air at room temperature for 10 minutes, and the treated thermal head was placed in a thermostatic oven at 70° C. for 30 minutes for heat treatment, to produce a thermal head having a film with low surface tension.

Performance of the surface-treated thermal head was tested as described below. The results are shown in Table 1.

Performance Test

Each of the thermal heads obtained in Examples 1 through 14 and Comparative Examples 1 through 3 was installed on a rotary stencil printing machine "RISOGRAPH (registered trade mark)" TR-153 produced by Riso Kagaku Corporation, and performance of the thermal head was evaluated in terms of the following items.

Evaluation Items (1) Film Perforation Property

Heat sensitive stencil sheets were perforated into stencils having solid pattern. The number of defective perforations was counted and the defective perforation rate per a unit number of perforations was calculated. The film perforation property was evaluated according to the following criterion:

Criterion

○ Less than 5%

Δ 5% to less than 10%

X 10% or more (2) Contamination of Thermal Head

Heat sensitive stencil sheets were continuously processed into stencils by about 1000 m or 3000 m, and then contamination on the surface of the thermal head was visually observed. Prevention of melt deposition was evaluated according to the following criterion.

Criterion

○ No deposition occurred.

Δ Some deposition occurred.

X Deposition occurred.

(3) Contact Angle

Immediately after surface treatment (initial) and after continuously processing heat sensitive stencil sheets into stencils by about 1000 m or 3000 m, contact angle of the surface of the thermal head against purified water was measured as an indicator of prevention of melt deposition on the thermal head surface as well as wear resistance of the surface-treating agent.

(4) Prevention of Thermal Fusion

After heat sensitive stencil sheets which are not treated with a releasing agent or the like for prevention of thermal fusion were processed into stencils, the melt deposited on the heating element of the thermal head was visually observed, and prevention of thermal fusion was evaluated according to the following criterion.

Criterion

○ No melt was deposited on the heating element.

Δ A Some melt was deposited on the heating element.

X Melt was deposited on the heating element.

TABLE 1

| | | Composition and treating conditions | | | | | | | | |
|---|---|---|---|---|---|---|---|---|---|---|
| | | Fluoroalkyl group-containing silane compound* (g) | Tetrachlorosilane (g) | Ethanol (g) | Water content wt % | HCl normality | Main ingredients** wt % | Molar ratio | Drying temperature | Remark |
| Example | 1 | A1 (0.020) | 1.0 | 100 | 0.35 | 0.2 | 1.0 | 167 | Room temperature | |
| | 2 | A1 (0.020) | 1.0 | 100 | 0.33 | 0.2 | 1.0 | 167 | 90° C. | |
| | 3 | A1 (0.006) | 1.0 | 100 | 0.36 | 0.2 | 1.0 | 557 | Room temperature | |
| | 4 | A1 (0.060) | 1.0 | 100 | 0.37 | 0.2 | 1.0 | 56 | Room temperature | |
| | 5 | A1 (0.120) | 6.0 | 100 | 0.32 | 1.4 | 5.8 | 167 | Room temperature | |
| | 6 | A1 (0.240) | 12.0 | 100 | 0.34 | 2.8 | 10.9 | 167 | Room temperature | |
| | 7 | A1 (0.006) | 0.25 | 100 | 0.31 | 0.1 | 0.3 | 139 | Room temperature | |
| | 8 | A1 (0.200) | 0.5 | 100 | 0.32 | 0.1 | 0.7 | 8 | Room temperature | |
| | 9 | A1 (0.700) | 0.5 | 100 | 0.33 | 0.1 | 1.2 | 2 | Room temperature | |
| | 10 | A1 (0.700) | 0.3 | 100 | 0.32 | 0.1 | 1.0 | 1 | Room temperature | |
| | 11 | A2 (0.020) | 1.0 | 100 | 0.33 | 0.2 | 1.0 | 167 | Room temperature | |
| | 12 | A3 (0.020) | 1.0 | 100 | 0.35 | 0.2 | 1.0 | 167 | Room temperature | |
| | 13 | A4 (0.020) | 1.0 | 100 | 0.34 | 0.2 | 1.0 | 167 | Room temperature | |
| | 14 | A1 (0.020) | 1.0 | 90 | 10.25 | 0.3 | 1.1 | 167 | Room temperature | |
| Comparative Example | 1 | — | — | — | — | — | — | — | — | No surface treatment |
| | 2 | — | — | — | — | — | — | — | — | Teflon surface treatment |
| | 3 | A1 (2.0) | — | 97 (IPA) | — | 0.2 | 2.0 | — | 70° C. | 1 part of nitric acid added |

*Fluoroalkyl group-containing silane compounds
A1 $[CF_3(CF_2)_7CH_2CH_2Si(OCH_3)_3]$
A2 $[CF_3(CF_2)_5CH_2CH_2Si(OCH_3)_3]$
A3 $[CF_3(CF_2)_9CH_2CH_2Si(OCH_3)_3]$
A4 $[CF_3(CF_2)_7CH_2CH_2SiCl_3]$
**(Main ingredients) = {(Fluoroalkyl group-containing silane compound) + (Tetrachlorosilane)}/{(Fluoroalkyl group-containing silane compound) + (Tetrachlorosilane) + (Ethanol)}

TABLE 2

| | | Film thickness nm | Film perforation property | Contact angle Initial | Contact angle After continuously making stencils | Prevention Contamination of thermal head | Prevention of thermal fusion | Remark |
|---|---|---|---|---|---|---|---|---|
| Example | 1 | 70 | ○ | 108° | 106° | ○ | ○ | |
| | 2 | 70 | ○ | 109° | 105° | ○ | ○ | |
| | 3 | 60 | ○ | 105° | 104° | Δ | ○ | |
| | 4 | 70 | ○ | 109° | 107° | ○ | ○ | |
| | 5 | 210 | ○ | 108° | 107° | ○ | ○ | |
| | 6 | 560 | Δ | 108° | 107° | ○ | ○ | Cracks occurred. |
| | 7 | 30 | ○ | 104° | 99° | Δ | Δ | |
| | 8 | 50 | ○ | 106° | 104° | ○ | ○ | |
| | 9 | 40 | ○ | 108° | 100° | Δ | Δ | |
| | 10 | 25 | ○ | 108° | 98° | Δ | Δ | |
| | 11 | 70 | ○ | 108° | 106° | ○ | ○ | |
| | 12 | 60 | ○ | 108° | 106° | ○ | ○ | |
| | 13 | 70 | ○ | 109° | 105° | ○ | ○ | |
| | 14 | 70 | ○ | 106° | 106° | ○ | ○ | |
| Comparative Example | 1 | — | ○ | 70° | 71° | x | x | Non-treated |
| | 2 | 3850 | x | 105° | 104° | ○ | ○ | Poor coating film |
| | 3 | 10 | ○ | 113° | 97° | Δ | x | |

According to this invention, a water-repellent, oil-repellent film, in which fluoroalkyl moiety of a fluoroalkyl group-containing silane compound is oriented at a high density, is strongly bonded to the surface of the protective layer of the thermal head. Thus, surface free energy is kept low, and the deposition of the melt of the thermoplastic resin film caused, for example, in the process of processing heat sensitive stencil sheets into stencils can be effectively prevented for a long period of time. The modified protective layer does not lower the efficiency of thermal conduction from the heat-generating resistor of the thermal head to the surface of the protective layer, and does not inhibit the contact between the thermoplastic resin film to be perforated and the thermal head. So, the thermal head is suitable for La perforating heat sensitive stencil sheets to make stencils and can also be applied to heat transfer printers and heat sensitive printers. Therefore, the surface of the heat sensitive recording medium to be perforated or printed by means of the thermal head does not require the thermal fusion preventive treatment using a releasing agent, etc. Furthermore, since the surface-treating agent of this invention contains a highly reactive chlorosilyl group-containing compound, the film can be strongly bonded to the surface of the protective layer by merely drying at a relatively low temperature. So, the possibility of impairing the electronic parts of the thermal head is low, and the treating agent can be easily used.

What is claimed is:

1. A thermal head which comprises an insulating substrate, a heat-generating resistor formed on the insulating substrate, an electroconductive layer connected with the heat-generating resistor for supplying electric power to it, and a protective layer formed on the heat-generating resistor and the electroconductive layer, wherein said protective layer is treated on a surface thereof with a dry film of a surface-treating agent containing a chlorosilyl group-containing compound and a fluoroalkyl group-containing silane compound.

2. A thermal head according to claim 1, wherein said surface-treating agent contains a chlorosilyl group-containing compound and a fluoroalkyl group-containing silane compound in an organic solvent.

3. A thermal head according to claim 2, wherein said organic solvent is a hydrophilic solvent.

4. A thermal head according to claim 3, wherein said hydrophilic solvent is an alcohol solvent or ketone solvent.

5. A thermal head according to claim 4, wherein said hydrophilic solvent contains 0 to 10 wt % of water based on the total weight of the solvent.

6. A thermal head according to claim 3, wherein said organic solvent contains an acid.

7. A thermal head according to claim 3, wherein said surface-treating agent contains a fluoroalkyl group-containing silane compound in a form that is partially hydrolyzed, in said organic solvent.

8. A thermal head according to claim 3, wherein said surface-treating agent contains a chlorosilyl group-containing compound with its chlorine atoms partially substituted by alkoxyl groups or hydroxyl groups in said organic solvent.

9. A thermal head according to any one of claims 3 through 8, wherein said surface-treating agent has a pH of 0 to 3.

10. A thermal head according to claim 2, wherein said surface-treating agent contains a chlorosilyl group-containing compound and a fluoroalkyl group-containing silane compound in an amount in total of 0.01 wt % to 10 wt % based on the total weight of the treating agent.

11. A thermal head according to claim 2, wherein said surface-treating agent contains the chlorosilyl group-containing compound in an amount of 5 to 500 as a molar ratio to the fluoroalkyl group-containing silane compound.

12. A thermal head according to claim 1, wherein contact angle of the surface of said surface-treated protective layer to water is 95° or more.

13. A thermal head according to claim 1, wherein said fluoroalkyl group-containing silane compound has a fluoroalkyl group with a carbon number of 6 to 10.

14. A thermal head according to claim 13, wherein said fluoroalkyl group-containing silane compound has a fluoroalkyl group with a carbon number of 8 to 10.

15. A thermal head according to claim 14, where said fluoroalkyl group-containing silane compound is heptadecafluorodecyltrimethoxysilane $\{CF_3(CF_2)_7CH_2CH_2Si(OCH_3)_3\}$.

16. A thermal head according to claim 1, wherein said chlorosilyl group-containing compound is chlorosilane or polychlorosiloxane represented by $Cl(SiCl_2O)_nSiCl_3$ (n denotes an integer of 1 to 10).

17. A thermal head according to claim 16, wherein said chlorosilane is tetrachlorosilane ($SiCl_4$), trichlorosilane ($SiHCl_3$), trichloromonomethylsilane ($SiCH_3Cl_3$) or dichlorosilane ($SiH_2Cl_2$).

18. A thermal head according to claim 1, wherein said protective layer has a surface made of a material having hydrophilic groups.

19. A thermal head according to claim 1, which is used for perforating heat sensitive stencil sheets to make stencils.

20. A surface-treating agent for making a vitreous surface of a thermal head water-repellent and oil-repellent, comprising a chlorosilyl group-containing compound and a fluoroalkyl group-containing silane compound in an organic solvent.

21. A surface-treating agent according to claim 20, wherein said vitreous surface is a protective layer of a thermal head, said thermal head comprising an insulating substrate, a heat-generating resistor formed on the insulating substrate, an electroconductive layer connected with the heat-generating resistor for supplying electric power to it, and a protective layer formed on the heat-generating resistor and the electroconductive layer.

22. A method of treating a surface of a thermal head having an insulating substrate, a heat-generating resistor formed on the insulating substrate, an electroconductive layer connected with the heat-generating resistor for supplying electric power to it, and a protective layer formed on the heat-generating resistor and the electroconductive layer, which comprises the steps of coating a surface of the protective layer with the surface-treating agent as set forth in claim 20 or 21 and drying, whereby the thermal head is modified to be water-repellent and oil-repellent on the surface of said protective layer.

23. A surface-treating method according to claim 22, wherein said surface-treating agent is coated and dried in atmospheric air.

24. A surface-treating method according to claim 23, wherein said drying is carried out by means of air drying.

25. A surface-treating method according to claim 23, wherein said drying is carried out by means of heating.

* * * * *